US006736329B2

(12) United States Patent
Doclo

(10) Patent No.: US 6,736,329 B2
(45) Date of Patent: May 18, 2004

(54) HEATING UNIT FOR HEAT-TRANSFER FLUID FOR A CENTRAL HEATING INSTALLATION

(76) Inventor: Ernest Doclo, 14 rue des Sablières, B-6200 Chatelet (BE)

( * ) Notice: Subject to any disclaimer, the term of this patent is extended or adjusted under 35 U.S.C. 154(b) by 0 days.

(21) Appl. No.: 10/297,658

(22) PCT Filed: May 17, 2001

(86) PCT No.: PCT/BE01/00087

§ 371 (c)(1),
(2), (4) Date: Dec. 9, 2002

(87) PCT Pub. No.: WO01/94860

PCT Pub. Date: Dec. 13, 2001

(65) Prior Publication Data

US 2003/0164402 A1 Sep. 4, 2003

(30) Foreign Application Priority Data

Jun. 9, 2000 (BE) ..... 2000/0374

(51) Int. Cl.[7] ..... F24H 3/00
(52) U.S. Cl. ..... 237/70; 237/73; 165/264
(58) Field of Search ..... 237/70, 2 A, 73, 237/26; 165/255, 262, 264

(56) References Cited

U.S. PATENT DOCUMENTS 3,558,852 A * 1/1971 Larenzo et al. ..... 219/211
3,608,625 A * 9/1971 Kendrick ..... 165/207
3,949,565 A * 4/1976 Roop ..... 62/50.2
3,958,555 A * 5/1976 Horne ..... 122/13.3
3,968,346 A 7/1976 Cooksley
4,469,935 A 9/1984 Candela
4,531,572 A * 7/1985 Molitor ..... 219/201

* cited by examiner

*Primary Examiner*—Derek Boles
(74) *Attorney, Agent, or Firm*—Piper Rudnick LLP

(57) ABSTRACT

A heating unit for heat-transfer fluid for a central heating installation including a tubular external wall, a first end wall and a second end wall forming a substantially cylindrical space; a first tubular internal partition located substantially concentrically within the tubular external wall and forming a first annular space between the tubular external wall and the first internal partition; a second internal partition having a diameter smaller than the first internal partition located substantially concentrically within the first internal partition and forming a second annular space between the first internal partition and the second internal partition; a central pipe located inside the second internal partition, the second annular space being in communication with the central pipe adjacent to the first end wall and in communication with the first annular space adjacent to the second end wall; an inlet orifice opening out of the first annular space adjacent to the first end wall; an outlet orifice in the second end wall opening out from the central pipe, at least one electric immersion heater mounted in the central pipe, and at least one thermostatic sensor mounted inwardly of the tubular external wall.

21 Claims, 2 Drawing Sheets

HEATING UNIT FOR HEAT-TRANSFER FLUID FOR A CENTRAL HEATING INSTALLATION

RELATED APPLICATION

This application is a 371 of International Application No. PCT/BE01/00087, with an international filing date of May 17, 2001, which is based on Belgian Patent Application No. 2000/0374, filed Jun. 9, 2000.

FIELD OF THE INVENTION

The invention concerns a heating unit for heat-transfer fluid for a central heating installation.

BACKGROUND

In general terms, a central heating installation comprises a pipework circuit in which one or more radiators or convectors are connected, at least one expansion device and at least one heating station able to heat the heat-transfer fluid which is caused to circulate in the circuit.

The heating station of the installation can in particular be a coal, gas or oil boiler, and there also exist electric heating stations.

It would be advantageous to produce a central heating installation in which the heating station consists of one or more electric heating units with a simple and compact structure, and allowing effective and flexible functioning of the installation.

SUMMARY OF THE INVENTION

The invention relates to a heating unit for central heating heat-transfer fluid. This heating unit comprises a reservoir having a tubular external wall, a first end wall and a second end wall, these walls delimiting a space which is in substance cylindrical. A first tubular internal partition and a second tubular internal partition, substantially concentric with the tubular external wall, are mounted in the reservoir, the second internal partition having a diameter smaller than that of the first tubular partition. A first annular space is situated between the tubular external wall and the first internal partition; a second annular space is situated between the first internal partition and the second internal partition; a central pipe is situated inside the second internal partition. The second annular space is in communication with the central pipe close to the first end wall and in communication with the first annular space close to the second end wall. The reservoir is provided with an inlet orifice opening out in the first annular space close to the first end wall and an outlet orifice, in the second end wall, opening out in the central pipe. At least one electric immersion heater is mounted in the central pipe, and at least one thermostatic sensor is mounted in the reservoir.

The components making up the heating unit are preferably made from metal.

In particular, the tubular external wall, the first and second end walls and the first internal partition can in particular be made from steel. The second internal partition can also be made from steel. According to another embodiment, this second internal partition is made from copper.

According to a preferred embodiment, the heating unit comprises, in the second annular space, heat transfer elements fixed to the said second external partition.

These heat transfer elements can in particular consist of two rings spaced apart from one another, fixed to the second internal partition and disposed perpendicular to the axis thereof, these two rings having in them several holes and being connected together by means of several metallic bars spaced apart from each other.

So as to have a large surface of contact with the heat-transfer fluid which surrounds them, these metallic bars advantageously have a ribbed external surface. For the same reason, these metallic bars can also carry fins.

The heat transfer elements are produced from a material having good conductivity. The two rings between which the metallic bars are mounted can be made from steel, but are advantageously made from copper. The metallic bars themselves are preferably made from copper.

As already mentioned above, at least one thermostatic sensor is mounted in the reservoir. In order to provide greater safety in functioning, it may be desirable for two thermostatic sensors to be mounted in the reservoir.

According to a particular embodiment, this thermostatic sensor or sensors are mounted in the second annular space.

According to a preferred embodiment, the first annular space is put in communication with the second annular space by means of several openings distributed over the periphery of the first internal partition, close to the second end wall.

The expression "close to the second end wall" means that the distance between the openings and the second end wall is appreciably smaller than (for example, no more than one quarter of) the distance between these openings and the first end wall.

Advantageously, a ring can be mounted in the first annular space, between the tubular external wall and the first internal partition. This ring which, in the axial direction, has in it several holes distributed along its periphery, is situated at an intermediate level between the inlet orifice of the reservoir and the openings which are provided in the first intermediate partition.

The second annular space is advantageously put in communication with the central pipe by the fact that a space is provided between the second internal partition and the first end wall.

According to a particular embodiment, the inlet orifice of the reservoir is provided in the tubular external wall, close to the first end wall. This orifice thus opens out radially in the first annular space.

The reservoir is preferably provided with means enabling it to be fixed to a support.

According to one advantageous embodiment, two electric immersion heaters are mounted in the central pipe of the heating unit.

When the central heating installation in which the heating unit is connected is in operation, only one of these immersion heaters or both immersion heaters may be put in operation, according to circumstances and requirements.

Another aspect of the invention is a central heating installation with a heat-transfer fluid, comprising a pipework circuit in which one or more radiators or convectors are connected, at least one circulation pump, at least one expansion device and at least one heating unit, this installation including at least one room thermostat. At least one heating unit according to the invention is connected in the circuit of this installation, the installation also comprising an automated control station able to receive the signals from the room thermostat or thermostats and from the thermostatic sensors of the heating unit or units, and to control the start-up and stoppage of the functioning of the circulation pump or pumps and of the immersion heater or heaters of the heating unit or units.

The heating installation according to the invention may if necessary comprise two or more heating units according to the invention, these heating units then being connected in parallel in the circuit.

The heat-transfer fluid circulating in the installation is preferably oil and, more particularly, a mineral oil specially designed for heat transfer.

The heating unit or units connected in the circuit are preferably able to heat the heat-transfer fluid to a temperature above 100° C.

The installation can in particular be adjusted so that the temperature of the heat-transfer fluid (in particular oil) is limited to a temperature of between 105° C. and 110° C., at the output from the heating unit or units.

BRIEF DESCRIPTION OF THE DRAWINGS

Other particularities and advantages of the invention will emerge from the description of a heating unit according to the invention given by way of non-limiting example, reference being made to the accompanying drawings, in which.

Figure 1:
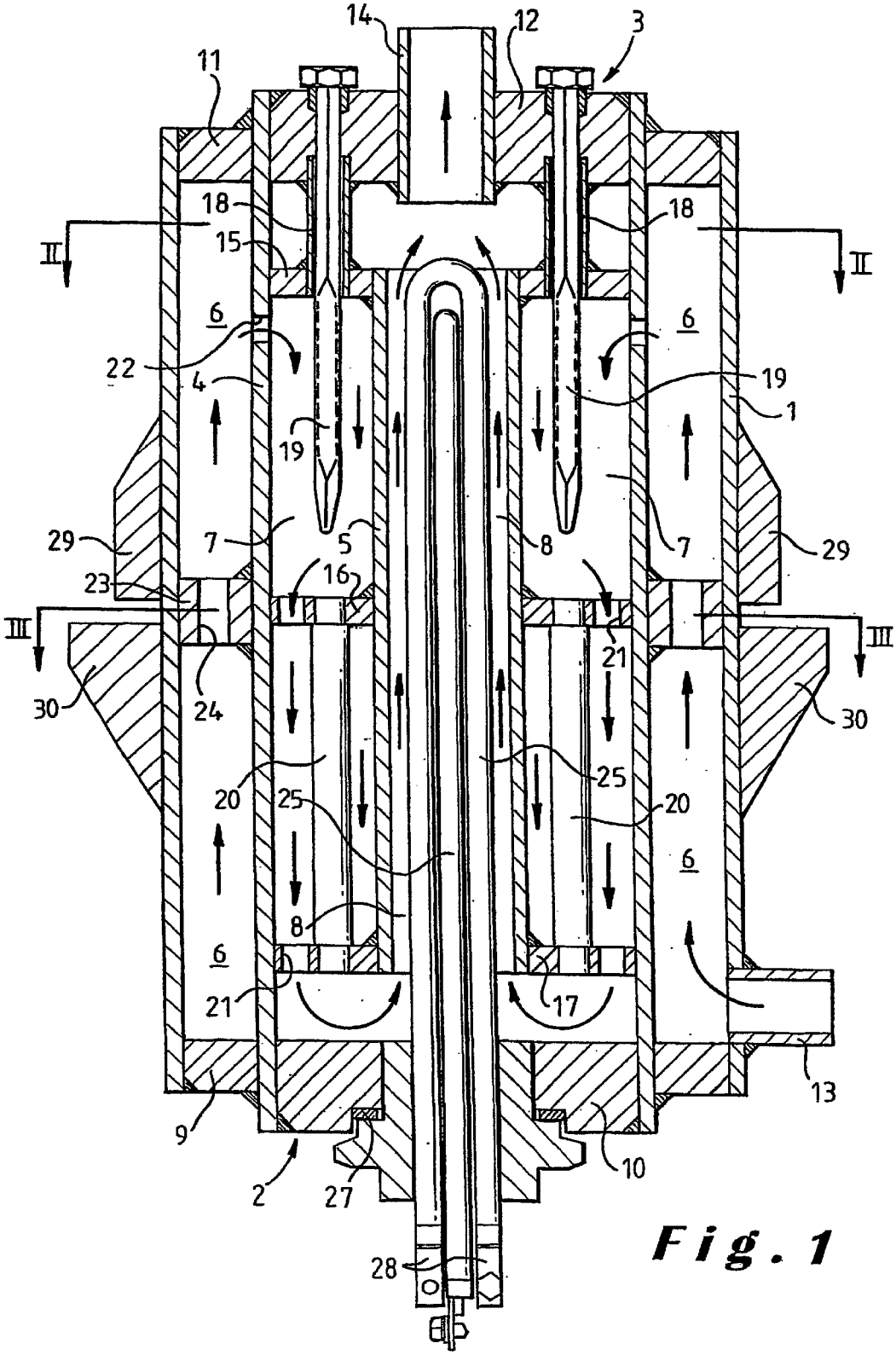
FIG. 1 is a view in axial section of the heating unit of the invention.
Figure 2:
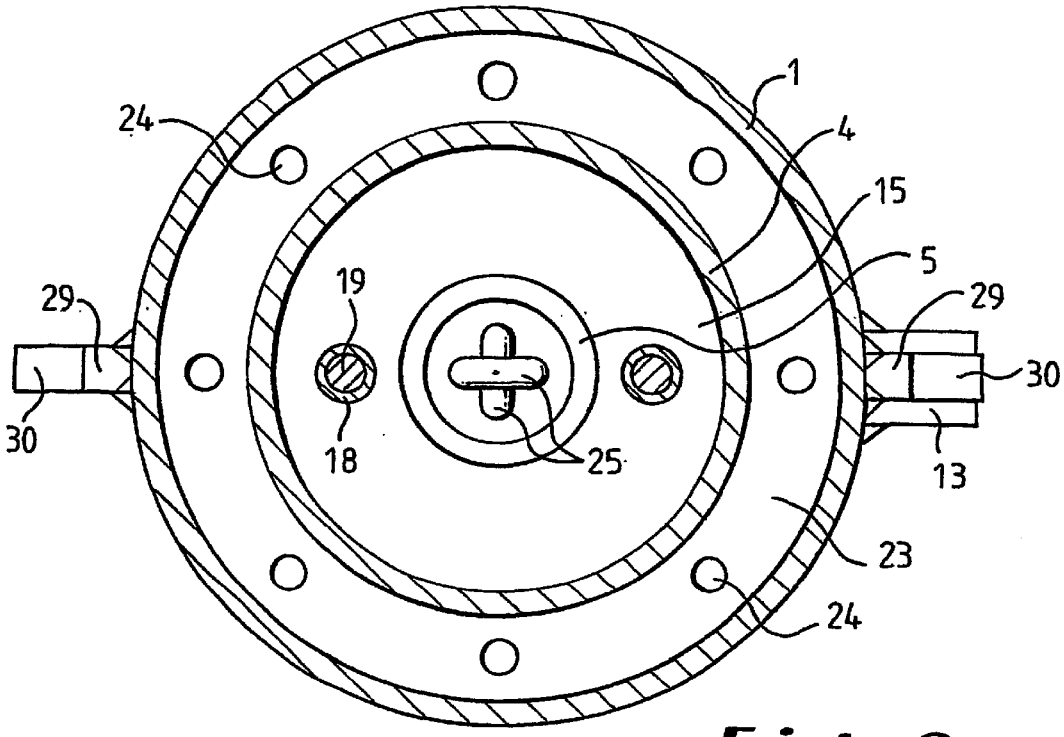
FIG. 2 is a transverse section of the heating unit taken along the line II—II in FIG. 1.

The heating unit comprises a reservoir having a tubular external wall 1, a first end wall 2 and a second end wall 3.

A first tubular internal partition 4, concentric with the external wall 1, is mounted in the reservoir. A second tubular internal partition 5, also concentric with the external wall 1, is mounted inside the first partition 4.

A first annular space 6 is thus situated between the external wall 1 and the first internal partition 3, and a second space 4 and the second internal partition 5. A central pipe 8 is situated inside the second tubular internal partition 5.

It should be noted that the first end wall 2 is in fact formed mainly by a ring 9 welded between the tubular elements which form respectively the external wall 1 and the first internal partition 4 and by a ring 10 welded between the tubular elements which form respectively the first internal partition 4 and the second internal partition 5.

In a similar fashion, the second end wall is formed mainly by a ring 11 welded between the tubular elements which form respectively the external wall 1 and the first internal partition 4 and by a ring 12 welded between the tubular elements which form respectively the first partition 4 and the second internal partition 5.

The reservoir is provided with an inlet orifice which comprises a manifold 13 welded to the external wall 1 and opening out in the first annular space 16, close to the first end wall 2.

The reservoir is also provided with an outlet orifice which opens out from the central pipe 8 and which comprises a manifold 14 welded in the ring 12 (which is an element making up the second end wall 3).

The second internal partition 5 carries on the outside three rings 15, 16, 17, whose external diameters are equal to (or slightly less than) the internal diameter of the first internal partition 4. The ring 15, which is situated closest to the second end wall 3, is connected to the ring 12 by two thimbles 18. Two thermostatic sensors 19 passing through orifices provided for this purpose in the ring 12, through the thimbles 18, are mounted in the second annular space 7. The connectors and electric wires which connect these thermostatic sensors 19 to a control station are not shown.

Figure 3:
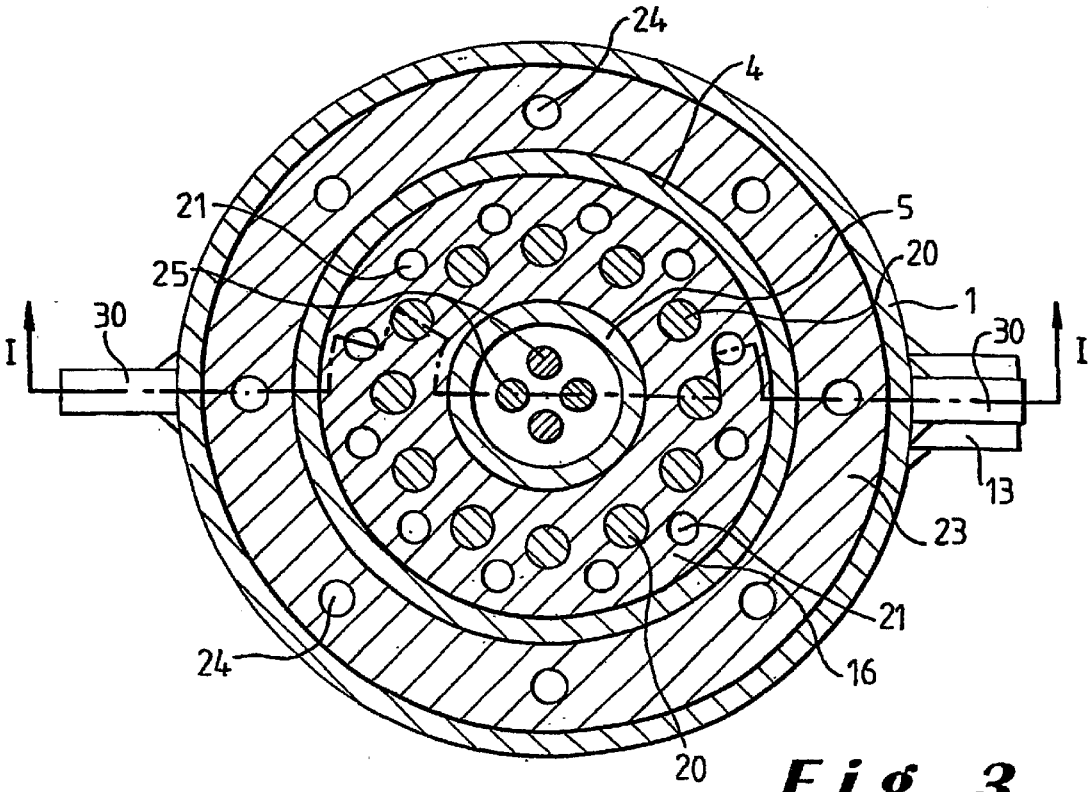
FIG. 3 is a transverse section of the heating unit taken along the line III—III in FIG. 1.

The other two rings 16 and 17 are spaced apart from one another and connected to one another by means of twelve copper bars 20 evenly spaced apart from each other. The rings 16 and 17 each have in them twelve holes 21 which are angularly offset with respect to the bars 20, as can be seen in FIG. 3.

Twelve holes 22 are provided in the first internal partition 4, close to the second end wall 3. These holes 22, which are evenly spaced apart on the periphery of the first tubular internal partition 4, put the first annular space 6 in communication with the second annular space 7.

A ring 23 with eight holes 24 in it is mounted between the external wall 1 and the first internal partition 4, at a level intermediate between the inlet manifold 13 and the holes 22 which are provided in the first internal partition 4. When the heating unit operates, this ring 23 with holes 24 regularises the flow of heat-transfer fluid which enters through the manifold 13 and which ascends towards the holes 22.

It will be noted that a space is provided between the second internal partition 5 and the first end wall 2, which puts the second annular space 7 in communication with the central pipe 8.

Two electric immersion heaters 25 are situated in the central pipe 8. These immersion heaters 25 are fixed in a base 26 which is screwed in the ring 10, a bridge 27 providing a seal for the assembly.

Connectors 28 connect the immersion heaters 25 to electric supply cables.

Shoulders 29, 30 are intended for fixing the heating unit to an appropriate support.

When the heating unit operates, an immersion heater 25 or the two immersion heaters 25 are started up. During this time, the heat-transfer fluid circulates in the heating unit by entering through the inlet 13, ascending in the first annular space 6, entering through the holes 22 into the second annular space 7, descending in the second annular space 7, and ascending again in the central pipe 8 as far as the outlet 14.

When it passes through the central pipe 8, the heat-transfer fluid is in direct contact with immersion heaters 25 which raise it to the required temperature. However, because of the thermal conductivity of the internal partitions 4 and 5, the heat-transfer fluid is already preheated during its passage through the first annular space 6 and then in particular during its passage through the second annular space 7 in which it comes into contact not only with the second intermediate partition 5 but also with the heat transfer elements 16, 17 and 20.

A heating unit as described is intended to be connected in the pipework circuit of a central heating installation. In the pipework circuit of such an installation there are generally connected several radiators, at least one heating unit, at least one circulation pump and at least one expansion device. The installation also comprises at least one room thermostat and an automated control station able to receive the signals from the room thermostat or thermostats and the thermostatic sensors of the heating unit (or heating units), and to control the start-up and stoppage of operation of the circulation pump (or circulation pumps) and of the immersion heater or heaters of the heating unit (or heating units).

The heating capacity of a heating unit obviously depends on the power of the immersion heaters mounted in the unit. Choosing immersion heaters with appropriate power makes it possible to meet a required heating capacity.

It may be desirable to connect two or more heating units, in parallel, in the circuit of a central heating installation. It is also advantageous for two immersion heaters to be mounted in each heating unit.

The control station of the installation can then be programmed so that, according to the heating requirement, one or two immersion heaters of one or more heating units would be started up. The control station is also programmed so that the heating unit or units can function only when the circulation pump or pumps are operating.

The heating units according to the invention are very compact, are of very simple construction, and allow great flexibility in operation of the installation in which they are connected.

The heat-transfer fluid which is caused to circulate in the installation is preferably mineral oil for the transfer of heat. This makes it possible in particular to heat the heat-transfer fluid to a temperature above 100° C., and this remains possible, without any problem, even at high altitude, in mountainous regions.

The heating unit according to the invention is a compact apparatus which contains only a small volume of heat-transfer fluid and which thereby has low thermal inertia.

If the radiators or convectors mounted in the installation are of the type with a large radiation surface and small internal volume, the installation overall will have low thermal inertia, which constitutes a real advantage.

What is claimed is:

1. A heating unit for heat-transfer fluid for a central heating installation comprising:

a tubular external wall, a first end wall and a second end wall forming a substantially cylindrical space;

a first tubular internal partition located substantially concentrically within the tubular external wall and forming a first annular space between the tubular external wall and the first internal partition;

a second internal partition having a diameter smaller than the first internal partition located substantially concentrically within the first internal partition and forming a second annular space between the first internal partition and the second internal partition;

a central pipe located inside the second internal partition, the second annular space being in communication with the central pipe adjacent to the first end wall and in communication with the first annular space adjacent to the second end wall;

an inlet orifice opening out of the first annular space adjacent to the first end wall;

an outlet orifice in the second end wall opening out from the central pipe;

at least one electric immersion heater mounted in the central pipe; and at least one thermostatic sensor mounted inwardly of the tubular external wall.

2. The heating unit according to claim 1, wherein the tubular external wall, the first and second end walls and the first internal partition are made from steel.

3. The heating unit according to claim 1, wherein the second internal partition is made from steel.

4. The heating unit according to claim 1, wherein the second internal partition is made from copper.

5. The heating unit according to claim 1, further comprising heat transfer elements located in the second annular space and fixed to the second internal partition.

6. The heating unit according to claim 5, wherein the heat transfer elements comprise two rings spaced apart from one another, fixed to the second internal partition and disposed perpendicular to an axis thereof, the two rings having a plurality of holes and connected together by a plurality of metallic bars spaced apart from each other.

7. The heating unit according to claim 6, wherein the metallic bars have a ribbed external surface.

8. The heating unit according to claim 6, wherein the two rings are made from steel.

9. The heating unit according to claim 6, wherein the two rings are made from copper.

10. The heating unit according to claim 6, wherein the metallic bars are made from copper.

11. The heating unit according to claim 1, wherein the at least one thermostatic sensor is mounted in the second annular space.

12. The heating unit according to claim 1, further comprising a plurality of openings distributed over the periphery of the first internal partition adjacent to the second end wall such that the first annular space and the second annular space are in communication with each other.

13. The heating unit according to claim 12, further comprising a ring having a plurality of holes distributed along its periphery mounted between the tubular external wall and the first internal partition and perpendicular to an axis of the cylindrical space and being located at a level intermediate between the inlet orifice and the openings provided in the first internal partition.

14. The heating unit according to claim 1, wherein a space is located between the second internal partition and the first end wall such that the second annular space and the central pipe are in communication with each other.

15. The heating unit according to claim 1, wherein the inlet orifice is provided in the tubular external wall.

16. The heating unit according to claim 1, further comprising means enabling the tubular external wall to be fixed to a support.

17. The heating unit according to claim 1, wherein the at least one electric immersion heater is mounted in the central pipe.

18. A central heating installation with a heat-transfer fluid comprising:

a pipework circuit in which there are connected one or more radiators or convectors;

at least one circulation pump;

at least one expansion device;

at least one room thermostat;

at least one heating unit according to claim 1 connected in the circuit; and an automated control station which receives signals from the at least one room thermostat and the at least one thermostatic sensor and to control start-up and stoppage of operation of the at least circulation pump and of the at least one electric immersion heater.

19. The central heating installation according to claim 18, wherein two or more heating units according to claim 1 are connected in parallel in the circuit.

20. The central heating installation according to claim 18, wherein the heat-transfer fluid is oil.

21. The central heating installation according to claim 20, wherein the at least one heating unit is adapted to heat the heat-transfer fluid to a temperature above 100° C.

* * * * *